US009556677B2

(12) United States Patent
Smith et al.

(10) Patent No.: US 9,556,677 B2
(45) Date of Patent: Jan. 31, 2017

(54) DIRECTIONAL DRILLING SYSTEMS

(71) Applicant: HALLIBURTON ENERGY SERVICES, INC., Houston, TX (US)

(72) Inventors: Raymond C. Smith, Beaumont, CA (US); Karim N. Kanji, Calgary (CA)

(73) Assignee: Halliburton Energy Services, Inc., Houson, TX (US)

( * ) Notice: Subject to any disclaimer, the term of this patent is extended or adjusted under 35 U.S.C. 154(b) by 526 days.

(21) Appl. No.: 13/747,338

(22) Filed: Jan. 22, 2013

(65) Prior Publication Data

US 2013/0213713 A1 Aug. 22, 2013

(30) Foreign Application Priority Data

Feb. 17, 2012 (WO) ..... PCT/US2012/025633

(51) Int. Cl.
*E21B 7/08* (2006.01)
*E21B 7/06* (2006.01)

(52) U.S. Cl.
CPC ..... *E21B 7/06* (2013.01); *E21B 7/067* (2013.01); *E21B 7/068* (2013.01)

(58) Field of Classification Search
CPC ..... E21B 7/06; E21B 7/067; E21B 7/068
See application file for complete search history.

(56) References Cited

U.S. PATENT DOCUMENTS 3,637,032 A 1/1972 Jeter
4,858,705 A 8/1989 Thiery
5,213,168 A 5/1993 Warren et al.
5,435,393 A 7/1995 Brekke et al.
5,803,179 A 9/1998 Echols et al.
5,875,859 A * 3/1999 Ikeda ..... E21B 7/067 175/256
6,216,802 B1 * 4/2001 Sawyer ..... 175/73
6,659,201 B2 12/2003 Head et al.
6,843,332 B2 1/2005 Eppink et al.
7,373,995 B2 5/2008 Hughes et al.
7,621,343 B2 11/2009 Chen et al.
(Continued)

FOREIGN PATENT DOCUMENTS

CN 101946059 1/2011
DE 4211059 7/1993
(Continued)

OTHER PUBLICATIONS

International Search Report with Written Opinion issued Jan. 29, 2013 for PCT Patent Application No. PCT/US12/025633, 11 pages.
(Continued)

*Primary Examiner* — Brad Harcourt
(74) *Attorney, Agent, or Firm* — Chamberlain Hrdlicka

(57) ABSTRACT

A directional drilling system for use in drilling a wellbore can include a bit deflection assembly with a bit axis deflection mechanism which applies a deflecting force to a shaft connected to a drill bit. The deflecting force may deflect the shaft, without being reacted between the deflection mechanism and the drill bit. The deflecting force may deflect the shaft between the drill bit and a radial bearing which maintains the shaft centered in the bit deflection assembly. The deflection mechanism may both angularly deflect and laterally displace the bit axis in the deflection mechanism.

51 Claims, 6 Drawing Sheets

(56) References Cited

U.S. PATENT DOCUMENTS

| | | | | |
|---|---|---|---|---|
| 2003/0094310 | A1 | 5/2003 | Eppink et al. | |
| 2004/0262043 | A1 | 12/2004 | Schuaf | |
| 2006/0042835 | A1* | 3/2006 | Guerrero et al. | 175/61 |
| 2006/0231258 | A1* | 10/2006 | Head | E21B 29/06 166/298 |
| 2007/0119629 | A1 | 5/2007 | Hughes et al. | |
| 2009/0166089 | A1 | 7/2009 | Millet | |
| 2010/0000794 | A1 | 1/2010 | Hall et al. | |
| 2011/0139513 | A1* | 6/2011 | Downton | 175/61 |
| 2011/0266063 | A1 | 11/2011 | Downton | |

FOREIGN PATENT DOCUMENTS

| | | |
|---|---|---|
| EP | 0563950 | 10/1993 |
| RU | 2136834 | 9/1999 |
| RU | 2179226 | 2/2002 |
| SU | 927948 | 5/1982 |
| WO | 03008754 | 1/2003 |

OTHER PUBLICATIONS

Halliburton; "SlickBore Matched Drilling Service", H02394, dated Apr. 2011, 2 pages.
Halliburton; "AGS (Adjustable Gauge Stabilizer) Tool", H02487, dated Dec. 2009, 2 pages.
Halliburton; "Full Speed Ahead", H03973, dated Oct. 2007, 4 pages.
Halliburton; "Geo-Pilot 5200 Series Rotary Steerable System", H04379, dated Nov. 2010, 2 pages.
Halliburton; "Directional Drilling Systems", H05476, dated Mar. 2010, 1 page.
Halliburton; "Pilot Fleet", H05544, dated Aug. 2008, 14 pages.
Halliburton; "Geo-Pilot GXT Rotary Steerable System", H05573, dated Apr. 2011, 2 pages.
Halliburton; Security DBS: BHP Billiton, Solution Profile article, dated 2004, 1 page.

* cited by examiner

DIRECTIONAL DRILLING SYSTEMS

CROSS-REFERENCE TO RELATED APPLICATION

This application claims the benefit under 35 USC §119 of the filing date of International Application Serial No. PCT/US12/25633 filed 17 Feb. 2012. The entire disclosure of this prior application is incorporated herein by this reference.

BACKGROUND

This disclosure relates generally to equipment utilized and operations performed in conjunction with drilling subterranean wells and, in one example described below, more particularly provides systems for directional drilling.

Directional drilling is the art of controlling a direction of drilling, in effect "steering" a drill bit, so that a wellbore is drilled in an earth formation in a desired location and direction. In the past, techniques have been developed for steering while sliding (e.g., without rotation of a drill string above a downhole motor) and steering while rotating the drill string.

It will be appreciated that improvements are continually needed in the art of directional drilling.

DETAILED DESCRIPTION

Figure 1:
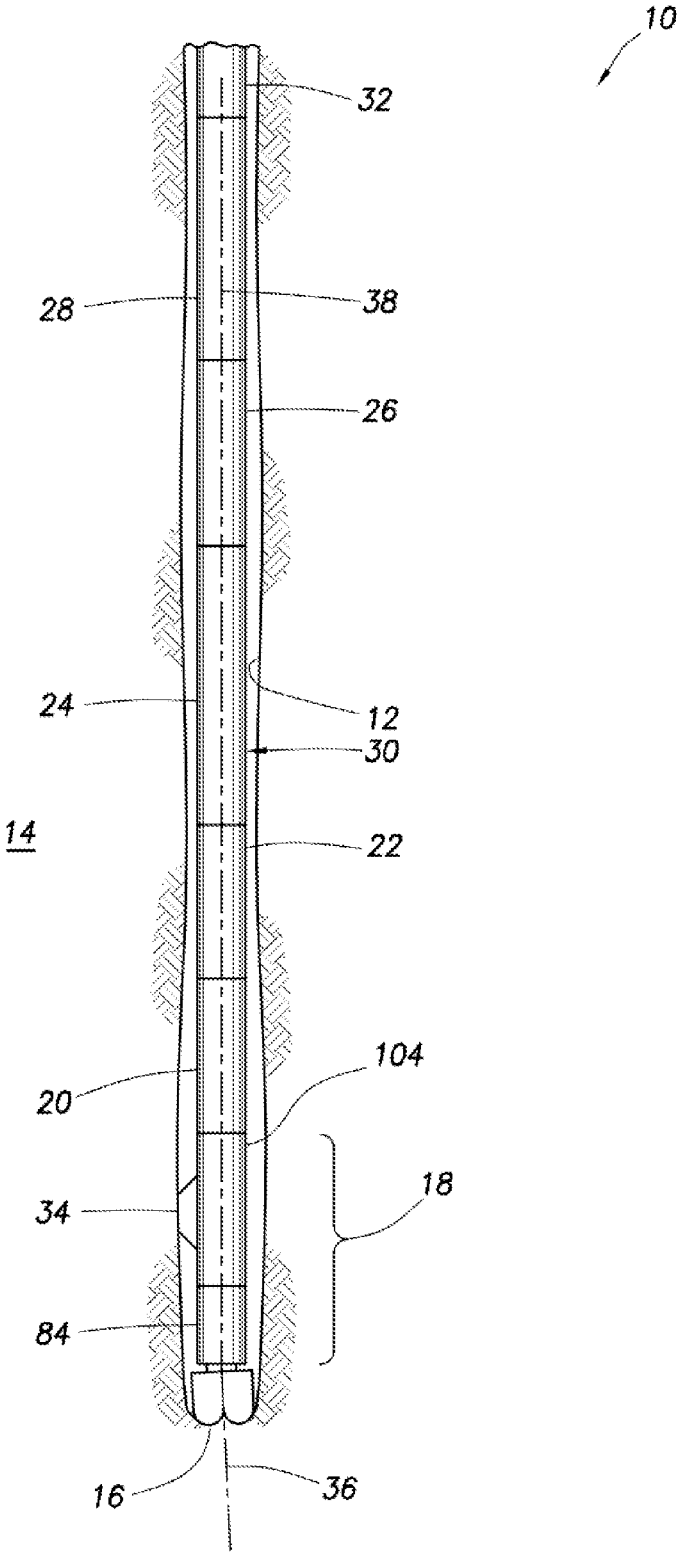
FIG. 1 is a representative partially cross-sectional view of a directional drilling system and associated method which can embody principles of this disclosure.

Representatively illustrated in FIG. 1 is a directional drilling system 10 and associated method which can embody principles of this disclosure. The system 10 is used to drill a wellbore 12 through an earth formation 14 in a desired direction.

In the example depicted in FIG. 1, the system 10 comprises a bottom hole assembly 30, which includes a drill bit 16, a bit deflection assembly 18, an optional articulated housing 20, a flex shaft assembly 22, a downhole motor 24 (such as a positive displacement motor, a "mud" motor, a turbine, etc.), a rotary connector 26, and downhole sensors and telemetry devices 28 (such as, measurement while drilling (MWD), pressure while drilling (PWD) and/or logging while drilling (LWD) sensors and telemetry transceivers, etc.).

The downhole sensors may include any number or combination of pressure, temperature, force, vibration, flow rate, torque, resistivity, radiation, and/or other types of sensors. The downhole telemetry devices can transmit and/or receive pressure pulse, electromagnetic, acoustic, wired, pressure level, flow rate, drill string 32 manipulation and/or other types of telemetry, for communication of data, commands, signals, etc., between downhole and remote locations (such as the earth's surface, another well location, a drilling rig, etc.). Combinations of telemetry modes may be used for redundancy, and different types of telemetry may be used for short hop and long hop communications.

The articulated housing 20, flex shaft assembly 22, motor 24, rotary connector 26 and sensors and telemetry devices 28 can be similar to conventional, well known tools used in the well drilling art, and so they are only briefly described here. However, modifications can be made to the tools, so that they are specially suited for use in the bottom hole assembly 30.

The articulated housing 20 permits the bottom hole assembly 30 to bend at the articulated housing. This allows the bottom hole assembly 30 to bend in a curved wellbore 12, and can in some examples allow the bit 16 to be deflected to a greater extent, and to produce a smaller radius wellbore curvature (e.g., achieving a higher build rate).

The articulated housing 20 could be adjustable, so that it has a desired, fixed bend, or the housing 20 could bend downhole as needed to accommodate the curvature of the wellbore 12. The articulated housing 20 could have a fixed bend, whether the wellbore 12 is being drilled with the drill string 32 rotating, or without the drill string rotating.

The articulated housing 20 could be used for a housing 84 in the bit deflection assembly 18, if desired. In this configuration, the articulated housing 20 could overlie a shaft articulation 54 (see FIGS. 2, 4 & 5).

The flex shaft assembly 22 includes a flexible shaft therein connected to a rotor of the motor 24, if the motor is a Moineau-type positive displacement motor. This allows the rotor to circulate in the motor 24, with torque being transmitted via the flexible shaft. The flex shaft assembly 22 would not necessarily be used if the motor 24 is a turbine or other type of motor.

Instead of the flexible shaft, a constant velocity joint or other type of flexible coupling could be used to connect a shaft to the rotor of a Moineau-type positive displacement motor. Thus, it should be understood that the principles of this disclosure are not limited to use of any particular well tools or combination thereof, since a wide variety of possibilities exist for constructing different combinations of tools in the bottom hole assembly 30.

The rotary connector 26 transmits signals between a rotating shaft (e.g., connected to the rotor of the motor 24) and the sensors and telemetry devices 28. This allows lines (e.g., electrical conductors, optical waveguides, etc.) to be extended through the rotating shaft, rotor, etc., and to instruments, actuators, sensors, etc., below the motor 24.

Note that the various elements of the bottom hole assembly 30 are described here as merely one example of a combination of elements which can be used to accomplish directional drilling. However, it should be clearly understood that it is not necessary for every element depicted in the drawings or described herein to be included in a directional drilling system encompassed by the scope of this disclosure. Furthermore, directional drilling systems incorporating the principles of this disclosure can include additional or different elements not described here. Therefore, it will be appreciated that the scope of this disclosure is not limited at all to the details of the bottom hole assembly 30 or the system 10.

The bottom hole assembly 30 is connected to a bottom (or distal) end of a drill string 32. The drill string 32 extends to a remote location, such as a drilling rig (not shown). The drill string 32 could include continuous and/or segmented drill pipe, and could be made of steel, other metals or alloys, plastic, composites, or any other material(s).

Preferably, the drill string 32 is not rotated while the bit deflection assembly 18 deflects the drill bit 16, causing the wellbore 12 to be drilled toward the azimuthal direction (with respect to the wellbore) in which the bit is deflected. However, the system 10 could be used while steering with the drill string 32 rotating, if desired.

In one method of using the system 10, a longitudinal axis 36 of the drill bit 16 is collinear with a longitudinal axis 38 of the drill string 32 while the wellbore 12 is being drilled straight, and with the drill string rotating (although the motor 24 could also, or alternatively, be used to rotate the bit when drilling straight). When it is desired to change the direction of the wellbore 12, the drill string 32 is azimuthally oriented relative to the wellbore, so that the bit deflection assembly 18 when actuated will deflect the drill bit 16 in the desired direction. This azimuthal orientation of the drill string 32 can be achieved and verified by use of the sensors and telemetry devices 28.

The bit deflection assembly 18 is then actuated to deflect the drill bit 16 in the desired direction by a desired amount. The drill bit 16 may be angularly and/or laterally deflected by the bit deflection assembly 18. In examples described below, the amount of the deflection can be selectively and incrementally controlled.

The bit deflection can be controlled from a remote location, with the bit deflection assembly 18 providing confirmation each time the drill bit 16 is deflected. This control and confirmation can be communicated via the telemetry devices 28, via conductors in the drill string 32 (such as, in a wall of the drill string, etc.), or by any other technique.

While the bit 16 is deflected by the deflection assembly 18, the wellbore 12 is drilled using the motor 24. The amount of deflection of the bit 16 can be changed while the wellbore 12 is being drilled, and without requiring that the drill string 32 be manipulated in the wellbore (e.g., raising and lowering the drill string, applying a pattern of manipulations to the drill string, etc.), although such manipulations could be used if desired.

After drilling a curved section of the wellbore 12 with the bit 16 being deflected by the deflection assembly 18, the wellbore can again be drilled straight by actuating the deflection assembly 18 to withdraw the deflection of the bit (although the wellbore can be drilled straight by rotating the drill string 32 while the bit is deflected). The actuation of the deflection assembly 18 to withdraw the bit deflection can be performed while the wellbore 12 is being drilled.

It will be appreciated by those skilled in the art that this system 10 allows a driller to conveniently initiate changes in direction while drilling, with no need to retrieve the drill string 32 and bottom hole assembly 30 from the well to do so. Instead, an appropriate signal can be sent from a remote location (such as a drilling rig) to the bit deflection assembly 18 (e.g., via telemetry, wired or wireless communication) whenever it is desired to initiate or withdraw deflection of the drill bit 16.

Figure 2:
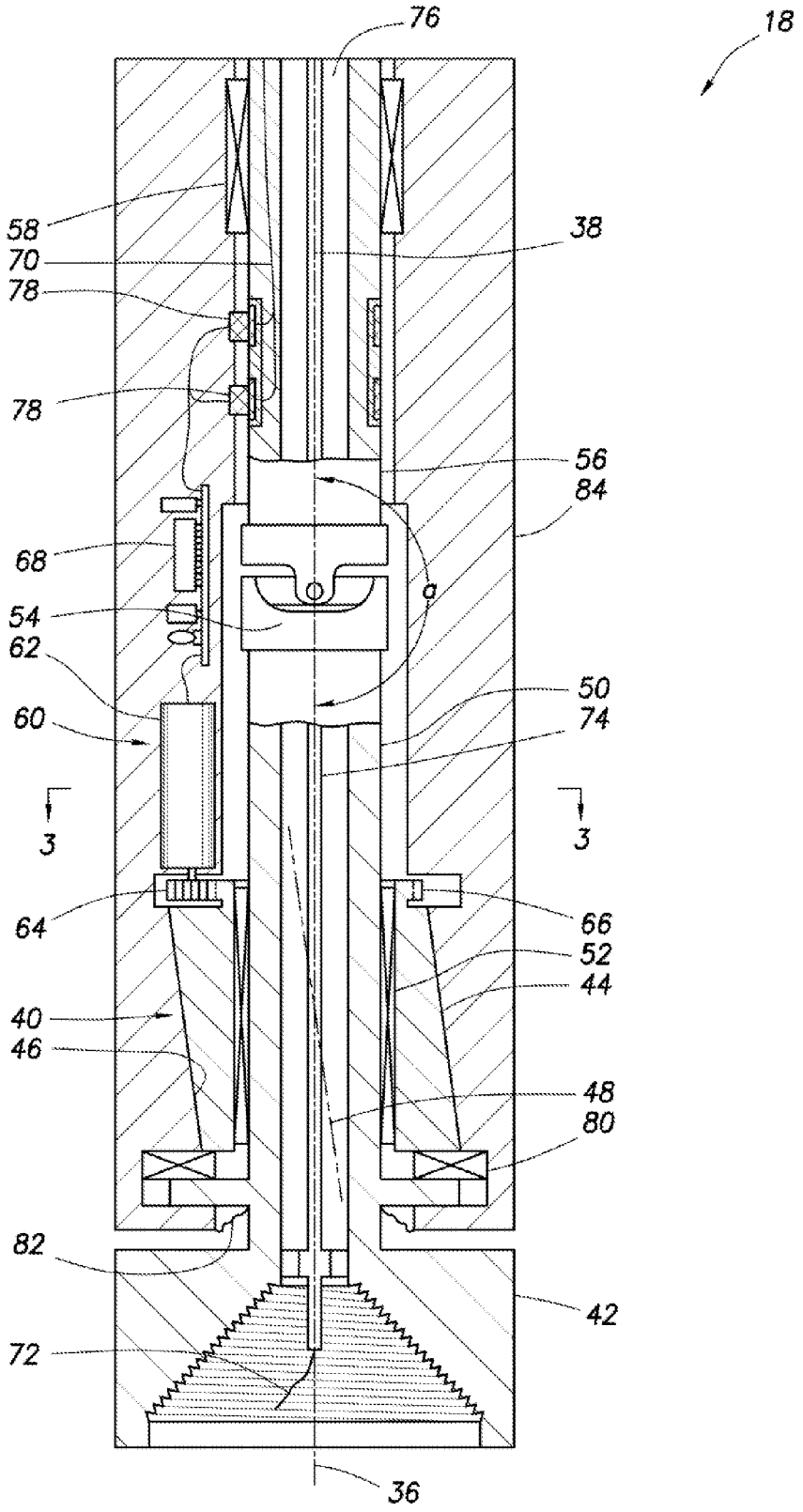
FIG. 2 is a representative enlarged scale cross-sectional view of a bit deflection assembly which may be used in the directional drilling system of FIG. 1.

Referring additionally now to FIG. 2, an enlarged scale cross-sectional view of one example of the bit deflection assembly 18 is representatively illustrated. In this example, the bit deflection assembly 18 includes a bit axis deflection mechanism 40 positioned in close proximity to a bit connector 42 used to connect the bit 16 to the bottom hole assembly 30.

By using the deflection mechanism 40 to deflect the bit axis 36 in close proximity to the bit 16, more curvature can be induced in the wellbore 12 as it is being drilled. The amount of this curvature (also known as "build rate") can be conveniently changed while drilling by rotating an inner cylinder 44 relative to an outer cylinder 46 of the deflection mechanism 40.

The cylinders 44, 46 are inclined relative to the bit axis 36 and drill string axis 38. The cylinders 44, 46 have a longitudinal axis 48 which is inclined relative to, and non-collinear with each of, the bit axis 36 and drill string axis 38. As a result, when the inner cylinder 44 is rotated relative to the outer cylinder 46, the bit axis 36 is rotated about the cylinder axis 48, thereby angularly deflecting the bit axis.

A shaft 50 is received in the inner cylinder 44. A radial bearing 52 provides radial support for the shaft 50, while allowing the shaft to rotate within the deflection mechanism 40.

The shaft 50 is collinear with the bit axis 36, and the shaft 50 is angularly deflected (that is, an angle a between the bit axis and the drill string axis 38 is changed) when the inner cylinder 44 is rotated relative to the outer cylinder 46. A torque-transmitting articulation 54 is provided for connecting the shaft 50 to another shaft 56 which is rotated by the motor 24 (e.g., in the FIG. 1 system 10, the shaft 56 could be connected to the flexible shaft of the flex shaft assembly 22).

The articulation 54 allows the shaft 50 (connected to the bit 16 via the connector 42) to angularly deflect relative to the shaft 56. The shaft 56 is maintained collinear with the drill string axis 38 by a radial bearing 58.

The articulation 54 depicted in FIG. 2 comprises a constant velocity joint. However, in other examples, a flexible shaft, a splined ball joint, or another type of articulation could be used.

The inner cylinder 44 is rotated relative to the outer cylinder 46 by means of an actuator 60. The actuator 60 in this example comprises an electric motor 62 with a gear 64 which engages teeth 66 on the inner cylinder 44. In other examples, other types of actuators (such as, hydraulic motors, pumps and pistons, linear actuators, piezoelectric actuators, etc.) could be used instead of the electric motor 62 and gear 64.

The actuator 60 is controlled by control and communication circuitry 68. For example, the circuitry 68 can control whether and how much the inner cylinder 44 is rotated by the motor 62, the angular deflection of the bit axis 36, etc. As another example, the circuitry 68 can communicate (e.g., to a remote location) a verification that a commanded deflection has been achieved, a measurement of the rotation of the inner cylinder 44, a measurement of the deflection of the bit axis 36, etc.

In the deflection assembly 18 of FIG. 2, communication with the circuitry 68 is via lines 70 (such as, electric, optical, and/or other types of lines) extending through a sidewall of the shaft 56 from the bottom hole assembly 30 above the deflection assembly 18. In addition, or alternatively, lines 72 can extend through a conduit 74 in an inner flow passage 76. The lines 72 can be connected to sensors, instruments, etc., below the bit deflection assembly 18 (such as, sensors in the bit 16 which can sense properties of the formation 14 ahead of the bit).

Slip ring contacts 78 can be used to electrically connect the circuitry 68 to the lines 70 and/or 72. The lines 70 and/or 72 may connect to the sensors and telemetry devices 28 described above, for example, for two-way telemetry of signals between the circuitry 68 and a remote location. In this manner, the circuitry 68 can receive commands, data, other signals, power (if not provided downhole, e.g., by batteries or a downhole generator), etc., from the remote location, and the remote location can receive sensor measurements, other data, verification of bit axis 36 deflection, etc., from the circuitry.

Although not illustrated in FIG. 2, various sensors may be provided in the deflection assembly 18 for measurement of parameters related to the deflection of the bit axis 36. For example, a rotary displacement sensor may be used to measure rotation of the inner cylinder 44. As another example, a displacement sensor may be used to directly or indirectly measure angular displacement of the shaft 50. Any type or combination of sensors may be used in the deflection assembly 18, in keeping with the scope of this disclosure. The sensors could be as simple as switches or contacts which engage or disengage, depending on the rotational position of the inner cylinder 44.

As another example, the motor 62 could be a stepper motor, which produces individual rotational steps. The steps in each rotational direction could be summed, in order to determine the total angular rotation of the inner cylinder 44 relative to the outer cylinder 46.

A thrust bearing 80 reacts an axial force produced by engagement of the bit 16 with the formation 14 at the bottom of the wellbore 12, with all or part of a weight of the drill string 32 being applied to the bit via the bottom hole assembly 30. A rotary seal 82 isolates the interior of a housing 84 of the deflection assembly from fluids, debris, etc., in the wellbore 12, while accommodating the deflection of the shaft 50 therein.

Figure 3:
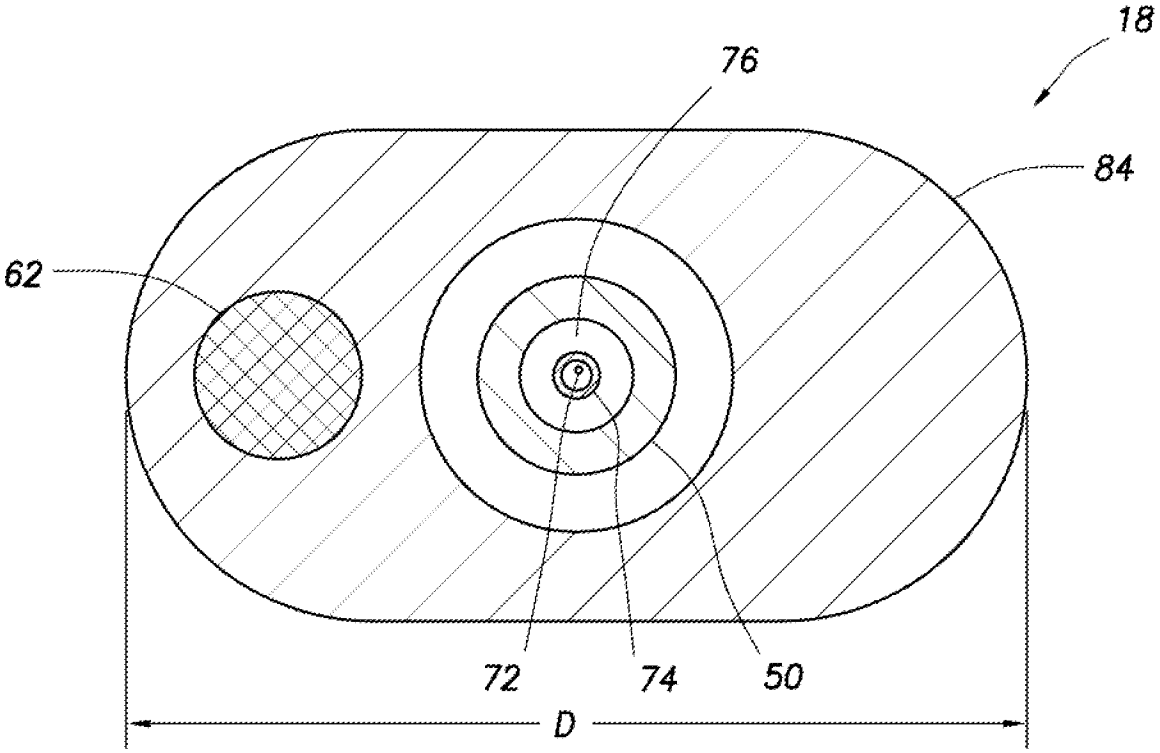
FIG. 3 is a representative enlarged scale cross-sectional view of the bit deflection assembly, taken along line 3-3 of FIG. 2.

Referring additionally now to FIG. 3, a representative cross-sectional view of the deflection assembly 18 is representatively illustrated, taken along line 3-3 of FIG. 2. In this view, it may be seen that the housing 84 is non-cylindrical and oblong.

This configuration preferably allows additional space for components in the housing 84 and desirably stabilizes the housing in the wellbore 12 as it is being drilled. For this purpose, the housing 84 preferably has its widest lateral dimension D in the direction of deflection of the bit axis 36 by the deflection mechanism 40.

The dimension D is also preferably near a gauge diameter of the drill bit 16, for producing a smoother wellbore 12, less spiraling of the wellbore, etc. For example, the dimension D may be at least approximately 80% of the gauge diameter of the bit 16, or more preferably at least approximately 90% of the gauge diameter of the bit.

Figure 4:
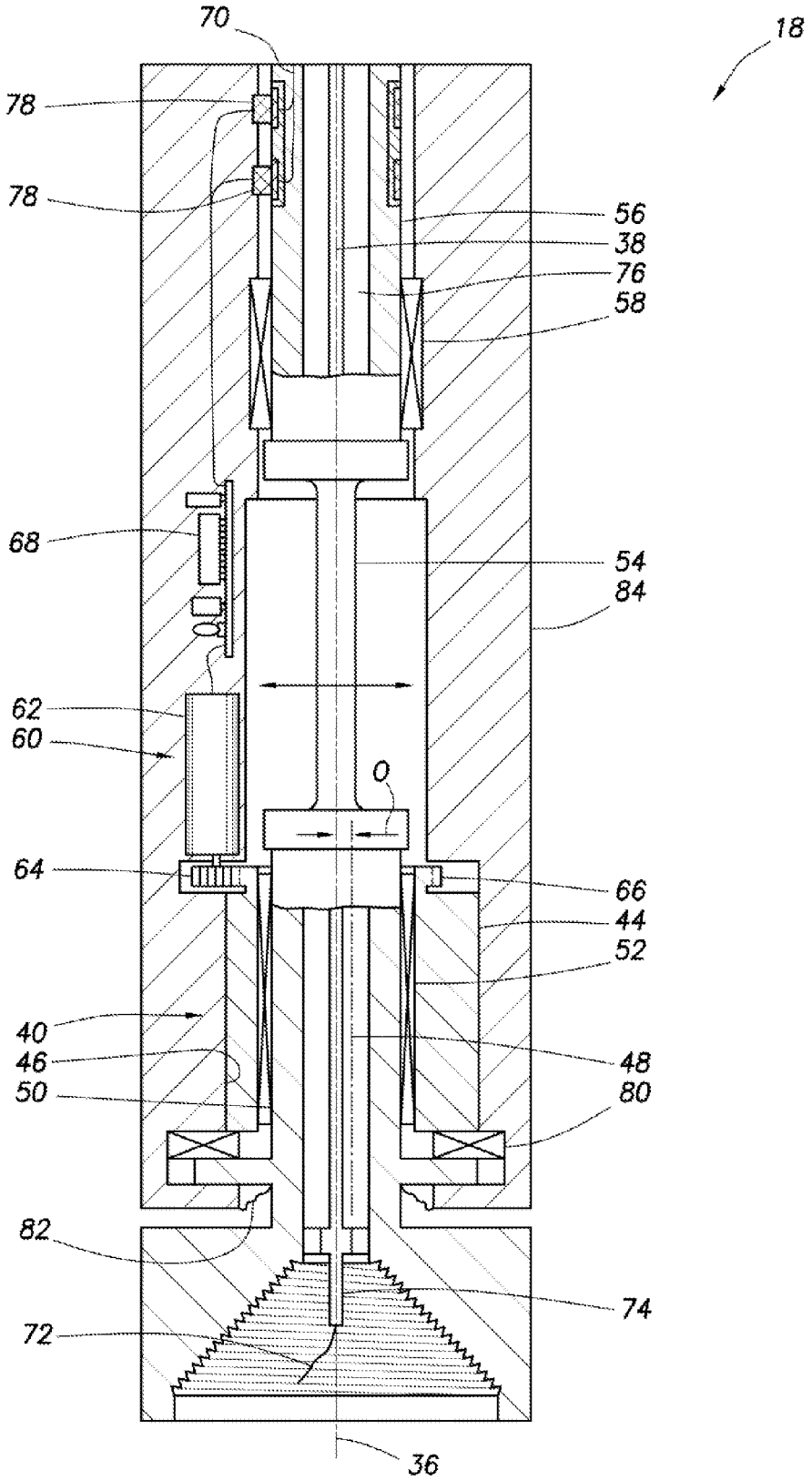
FIG. 4 is a representative cross-sectional view of another example of the bit deflection assembly.

Referring additionally now to FIG. 4, another example of the bit deflection assembly 18 is representatively illustrated. In this example, the cylinder axis 48 is not inclined relative to the bit axis 36, but is instead laterally offset (by dimension O). In addition, the shaft articulation 54 in the FIG. 4 example comprises a flexible torsion rod interconnected between the shafts 50, 56. The radial bearing 58 is positioned closer to the articulation 54, to react the lateral force imposed when the shaft 50 and bit axis 36 are displaced laterally by the deflection mechanism 40.

When the inner cylinder 44 is rotated by the motor 62, the bit axis 36 is rotated about the cylinder axis 48, thereby laterally offsetting the bit axis from the drill string axis 38. Maximum lateral offset will be achieved when the inner cylinder 44 is rotated 180 degrees from its FIG. 4 position.

Figure 5:
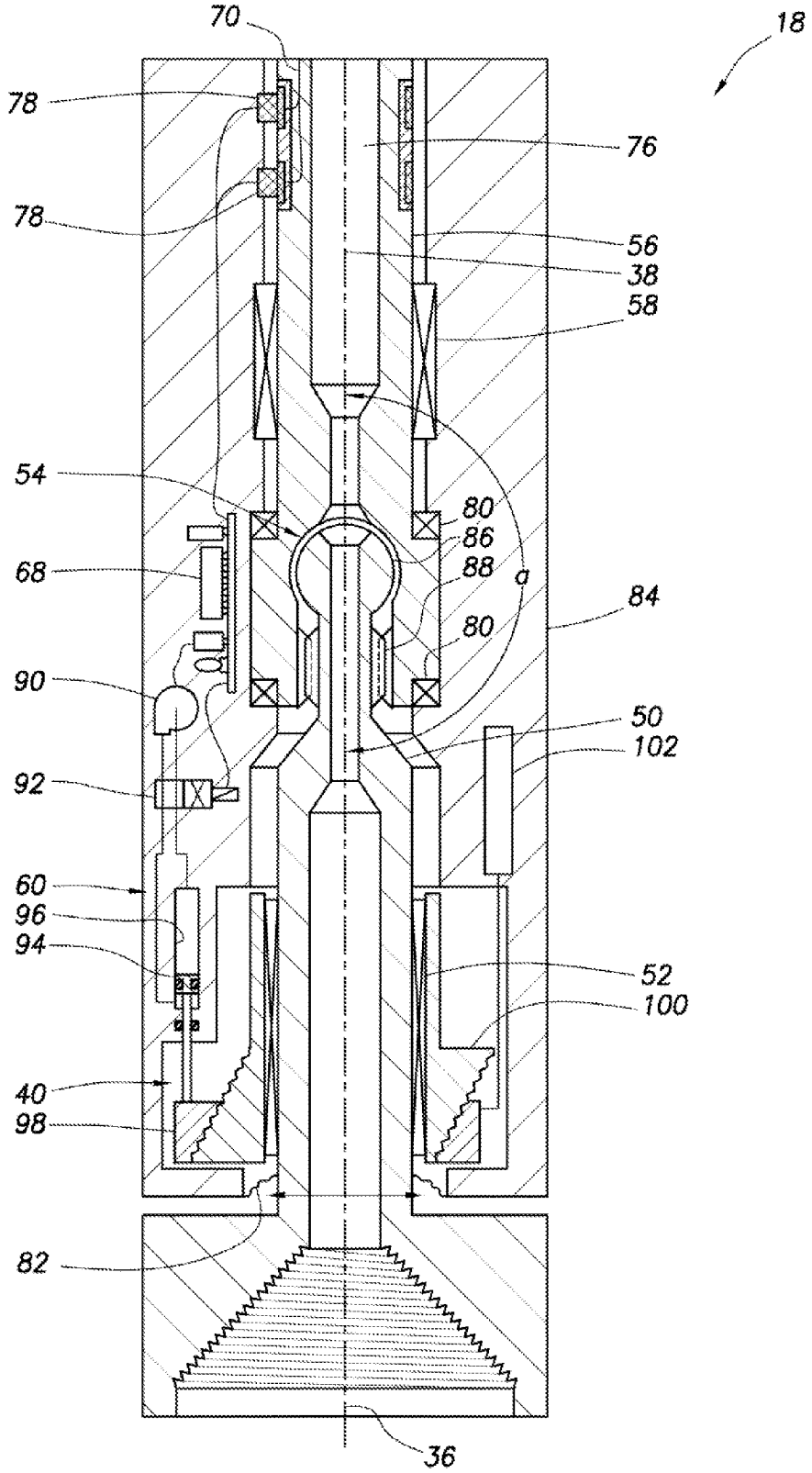
FIG. 5 is a representative cross-sectional view of a further example of the bit deflection assembly.

Referring additionally now to FIG. 5, another example of the bit deflection assembly 18 is representatively illustrated. In this example, the shaft articulation 54 comprises a ball joint 86 and splines 88. The ball joint 86 allows the bit axis 36 to angularly deflect relative to the drill string axis 38, and the splines 88 transmit torque from the shaft 56 to the shaft 50.

The actuator 60 in the FIG. 5 example comprises a pump 90, a control valve 92, a piston 94 and a cylinder 96. The pump 90 and control valve 92 can be operated by the circuitry 68 to displace the piston 94 in either direction in the cylinder 96.

The piston 94 is connected to a stepped wedge 98 engaged with another stepped wedge 100 in which the shaft 50 is received. The radial bearing 52 allows for rotation of the shaft 50 within the stepped wedge 100, and reacts lateral forces produced by lateral displacement of the shaft by the deflection mechanism 40.

By displacing the wedge 98 relative to the wedge 100, individual incremental lateral displacements of the bit axis 36 can be produced. A sensor 102 (such as, a linear variable displacement transducer, a potentiometer, etc.) can measure the position and/or displacement of the wedge 98, so that the lateral position of the shaft 50 can be readily determined.

Note that the bit axis 36 also rotates about the shaft articulation 54 when the lower end of the shaft 50 is laterally displaced by the deflection mechanism 40. Thus, the bit axis 36 is both laterally and angularly displaced by the deflection mechanism 40 in the deflection assembly 18.

One beneficial feature of the deflection assembly 18 examples of FIGS. 2-5 is that a deflecting force applied to the shaft 50 by the deflection mechanism 40 is not reacted between the deflection mechanism and the drill bit 16. Thus, any deflection of the bit axis 36 in the deflection mechanism 40 results in corresponding actual deflection of the drill bit 16. There are no radial bearings between the deflection mechanism 40 and the drill bit 16 which would react a lateral force applied to the shaft 50 by the deflection mechanism.

Figure 6:
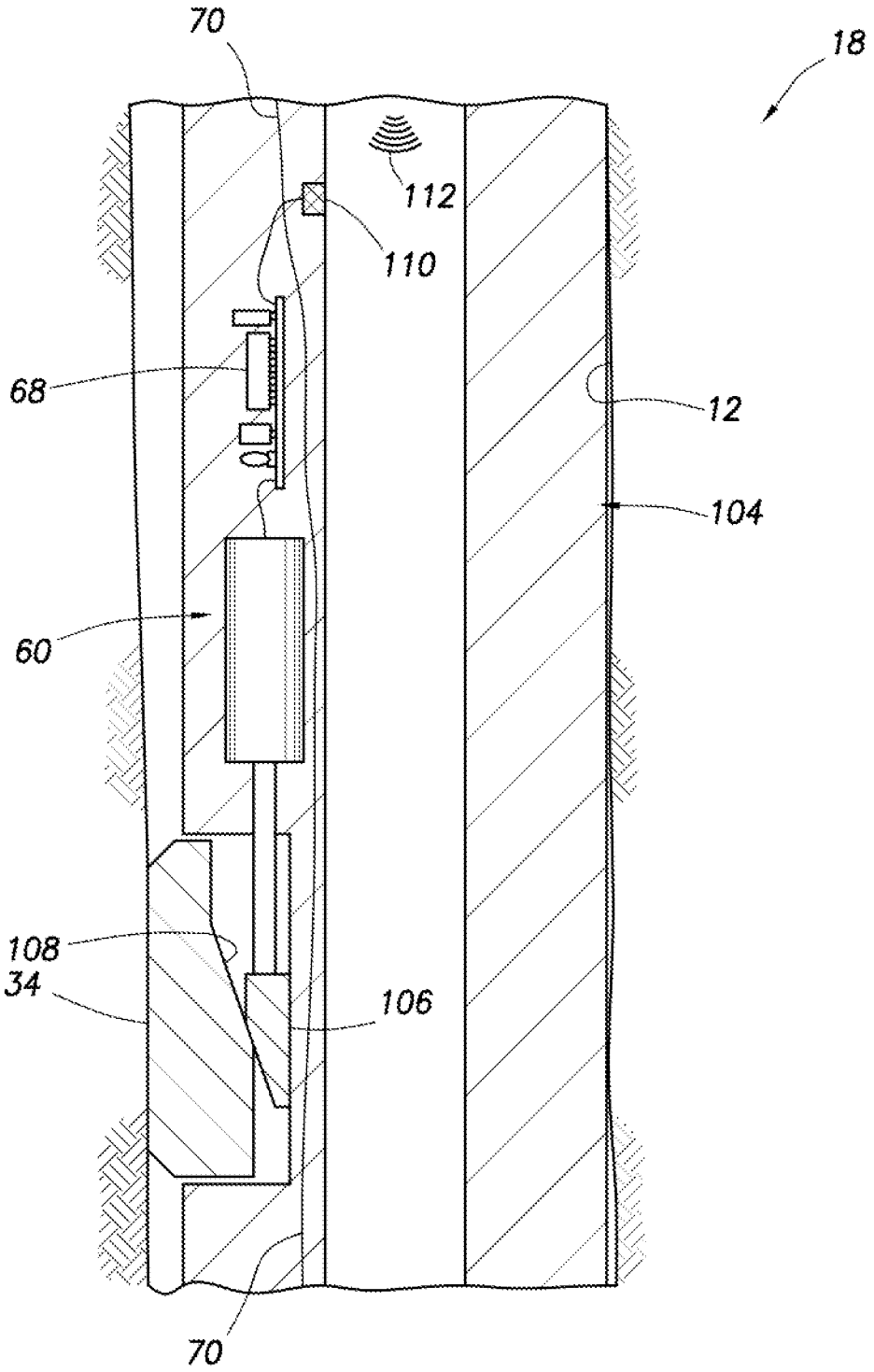
FIG. 6 is a representative cross-sectional view of a lateral deflection tool which may be used in the directional drilling system of FIG. 1.

Referring additionally now to FIG. 6, a lateral deflection device 104 can be included in the bit deflection assembly 18. The lateral deflection device 104 is used to laterally deflect the bit deflection assembly 18 in the wellbore 12.

The laterally extendable structure 34 extends outward from the deflection device 104 and contacts a wall of the wellbore 12. This laterally deflects the deflection assembly toward an opposite side of the wellbore 12, as depicted in FIG. 6.

A similar actuator 60 and circuitry 68 may be used in the deflection device 104 as described above for the deflection of the bit axis 36 in the deflection assembly 18. In the FIG. 6 example, the actuator 60 is used to displace a wedge 106 which engages an inclined surface 108 on the structure 34. Any type of actuator 60 (e.g., electric, hydraulic, piezoelectric, optical, etc.) may be used in the device 104.

The circuitry 68 is connected to a sensor 110 (such as a pressure sensor, antenna, etc.) which can detect a signal 112 (such as a pressure pulse, electromagnetic signal, etc.) transmitted from a remote location. The circuitry 68 can respond to an appropriate signal 112 by operating the actuator 60 to extend or retract the structure 34.

Although the deflection device 104 is depicted in FIG. 6 with the wedge 106 being used to displace the structure 34, it will be appreciated that any of the deflection mechanisms 40 described above for deflecting the shaft 50 could also be used for deflecting the structure, with appropriate modification. Thus, the deflection device 104 can be provided with stepped, incremental, individual deflections of the structure 34, with the amount of deflection being controlled from a remote location, and with verification of the deflection being communicated from the device 104 to the remote location, while the wellbore 12 is being drilled.

As depicted in FIG. 1, the deflection device 104 is preferably positioned in close proximity to the housing 84 containing the deflection mechanism 40 for deflecting the bit axis 36. In this manner, greater curvature of the wellbore 12 (e.g., a greater build rate) can be obtained, due to lateral deflection of the assembly 18 in the wellbore 12 (by the deflection device 104) while the bit axis 36 is also deflected in the same azimuthal direction relative to the wellbore (by the deflection mechanism 40).

In any of the examples described above, deflection of the shaft 50 or structure 34 can be locked (thereby preventing undesired change in the deflection) using any type of locking device. For example, a mechanical, hydraulic, electrical or other type of locking device may be used.

It may now be fully appreciated that the above disclosure provides significant advancements to the art of directional drilling. In various examples described above, the bottom hole assembly 30 can achieve increased build rates, while also allowing deflection of the bit axis 36 to be remotely controlled and such deflection to be verified, as the wellbore 12 is being drilled.

A directional drilling system 10 for use in drilling a wellbore 12 is described above. In one example, the system 10 can include a bit deflection assembly 18 including a bit axis deflection mechanism 40 which applies a deflecting force to a shaft 50 connected to a drill bit 16. The deflecting force deflects the shaft 50 without being reacted between the deflection mechanism 40 and the drill bit 16. This can provide for greater deflection of the bit axis 36, resulting in greater build rates, increased curvature of the wellbore 12, etc.

The deflection mechanism 40 may be interconnected between the drill bit 16 and an articulation 54 which permits deflection of the shaft 50. The articulation 54 can comprise a constant velocity joint, a splined ball joint and/or a flexible torsion rod.

The deflection mechanism 40 may rotate the bit axis 36 about an inclined axis 48. The inclined axis 48 can be formed in an inclined cylinder 44 which is rotated about the shaft 50.

The deflection mechanism 40 may laterally and/or angularly displace the bit axis 36.

The deflection mechanism 40 may deflect the shaft 50 in a succession of separate steps.

A housing 84 which encloses the deflection mechanism 40 can be non-cylindrical and/or can have an oblong lateral cross-section.

A laterally extendable structure 34 may selectively laterally deflect the bit deflection assembly 18. The structure 34 may apply a biasing force to a wall of the wellbore 12 in response to a signal 112 transmitted from a remote location. The deflection mechanism 40 may be positioned between the extendable structure 34 and the drill bit 16.

A sensor 102 can sense multiple different deflections of the bit axis 36 by the deflection mechanism 40.

A signal indicating a deflection of the bit axis 36 can be transmitted to a remote location.

Also described above is a directional drilling system 10 which, in one example, can comprise a bit deflection assembly 18 including a bit axis deflection mechanism 40 which applies a deflecting force to a first shaft 50 connected to a drill bit 16. The deflecting force can deflect the first shaft 50 between the drill bit 16 and a radial bearing 58 which maintains a second shaft 56 centered in the bit deflection assembly 18.

The bit deflection assembly 18 can be free of any radial bearing which is positioned between the deflection mechanism 40 and the drill bit 16, and which maintains the shaft 50 laterally centered.

The above disclosure also provides to the art a directional drilling system 10 in which the deflection mechanism 40 both angularly deflects and laterally displaces the bit axis 36 in the deflection mechanism 40.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A directional drilling system for use in drilling a wellbore, the system comprising:

a housing;

a shaft located in the housing;

a drill bit connected to and rotatable by the shaft, the drill bit having a bit axis; and a bit deflection assembly located in the housing and comprising a bit axis deflection mechanism comprising a cylinder rotatable to apply a deflecting force to the shaft to deflect the shaft without being reacted between the deflection mechanism and the drill bit.

2. The system of claim 1, wherein the deflection mechanism is interconnected between the drill bit and an articulation which permits deflection of the shaft.

3. The system of claim 2, wherein the articulation comprises a constant velocity joint.

4. The system of claim 2, wherein the articulation comprises a splined ball joint.

5. The system of claim 2, wherein the articulation comprises a flexible torsion rod.

6. The system of claim 1, wherein the deflection mechanism is configured to rotate the bit axis about an inclined axis.

7. The system of claim 6, wherein the inclined axis is formed in the cylinder which is rotatable about the shaft.

8. The system of claim 1, wherein the deflection mechanism is configured to laterally displace the bit axis.

9. The system of claim 1, wherein the deflection mechanism is configured to angularly deflect the bit axis.

10. The system of claim 1, wherein the deflection mechanism is configured to deflect the shaft in a succession of separate steps.

11. The system of claim 1, wherein the housing encloses the deflection mechanism and is non-cylindrical.

12. The system of claim 1, wherein the housing encloses the deflection mechanism and has an oblong lateral cross-section.

13. The system of claim 1, further comprising a laterally extendable structure which is configured to selectively laterally deflect the bit deflection assembly.

14. The system of claim 13, wherein the structure is configured to apply a biasing force to a wall of the wellbore in response to a signal transmitted from a remote location.

15. The system of claim 13, wherein the deflection mechanism is positioned between the extendable structure and the drill bit.

16. The system of claim 1, wherein a sensor is configured to sense multiple different deflections of the bit axis by the deflection mechanism.

17. The system of claim 1, wherein a signal indicating a deflection of the bit axis is transmittable to a remote location.

18. A directional drilling system for use in drilling a wellbore, the system comprising:

a housing having a housing axis;

a first shaft located in the housing;

a second shaft;

a radial bearing configured to maintain the second shaft collinear with the housing axis;

a drill bit connected to and rotatable by the first shaft, the drill bit having a bit axis; and a bit deflection assembly located in the housing and including a bit axis deflection mechanism comprising a cylinder rotatable to apply a deflecting force to the first shaft to deflect the first shaft between the drill bit and the radial bearings without being reacted between the deflection mechanism and the drill bit.

19. The system of claim 18, wherein the deflection mechanism is interconnected between the drill bit and an articulation which permits deflection of the first shaft relative to the second shaft.

20. The system of claim 19, wherein the articulation comprises a constant velocity joint.

21. The system of claim 19, wherein the articulation comprises a splined ball joint.

22. The system of claim 19, wherein the articulation comprises a flexible torsion rod.

23. The system of claim 18, wherein the deflection mechanism is configured to rotate the bit axis about an inclined axis.

24. The system of claim 23, wherein the inclined axis is formed in the cylinder which is rotatable about the first shaft.

25. The system of claim 18, wherein the deflection mechanism is configured to laterally displace the bit axis.

26. The system of claim 18, wherein the deflection mechanism is configured to angularly deflect the bit axis.

27. The system of claim 18, wherein the deflection mechanism is configured to deflect the first shaft in a succession of separate steps.

28. The system of claim 18, wherein the housing encloses the deflection mechanism and is non-cylindrical.

29. The system of claim 18, wherein the housing encloses the deflection mechanism and has an oblong lateral cross-section.

30. The system of claim 18, further comprising a laterally extendable structure which is configured to selectively laterally deflect the bit deflection assembly.

31. The system of claim 30, wherein the structure is configured to apply a biasing force to a wall of the wellbore in response to a signal transmitted from a remote location.

32. The system of claim 30, wherein the deflection mechanism is positioned between the extendable structure and the drill bit.

33. The system of claim 18, wherein a sensor is configured to sense multiple different deflections of the bit axis by the deflection mechanism.

34. The system of claim 18, wherein a signal indicating a deflection of the bit axis is transmittable to a remote location.

35. The system of claim 18, wherein the bit deflection assembly is free of any radial bearing which is positioned between the deflection mechanism and the drill bit, and which maintains the first shaft laterally centered.

36. A directional drilling system for use in drilling a wellbore, the system comprising:

a housing;

a shaft located in the housing;

a drill bit connected to and rotatable by the shaft, the drill bit having a bit axis;

a bit deflection assembly located in the housing and including a bit axis deflection mechanism comprising a stepped wedge engaged with an additional stepped wedge and configured to apply a deflecting force to the shaft by displacing the stepped wedge relative to the additional stepped wedge to angularly deflect and laterally displace the bit axis in the deflection mechanism.

37. The system of claim 36, wherein the deflection mechanism is configured to deflects the shaft without being reacted between the deflection mechanism and the drill bit.

38. The system of claim 36, wherein the deflection mechanism is interconnected between the drill bit and an articulation which permits deflection of the shaft.

39. The system of claim 38, wherein the articulation comprises a constant velocity joint.

40. The system of claim 38, wherein the articulation comprises a splined ball joint.

41. The system of claim 38, wherein the articulation comprises a flexible torsion rod.

42. The system of claim 36, wherein the deflection mechanism is configured to rotate the bit axis about an inclined axis.

43. The system of claim 42, wherein the inclined axis is formed in an inclined cylinder which is rotatable about the shaft.

44. The system of claim 36, wherein the deflection mechanism is configured to deflect the shaft in a succession of separate steps.

45. The system of claim 36, wherein the housing encloses the deflection mechanism and is non-cylindrical.

46. The system of claim 36, wherein the housing encloses the deflection mechanism and has an oblong lateral cross-section.

47. The system of claim 36, further comprising a laterally extendable structure which is configured to selectively laterally deflect the bit deflection assembly.

48. The system of claim 47, wherein the structure is configured to apply a biasing force to a wall of the wellbore in response to a signal transmitted from a remote location.

49. The system of claim 47, wherein the deflection mechanism is positioned between the extendable structure and the drill bit.

50. The system of claim 36, wherein a sensor is configured to sense multiple different deflections of the bit axis by the deflection mechanism.

51. The system of claim 36, wherein a signal indicating a deflection of the bit axis is transmittable to a remote location.

* * * * *